United States Patent [19]

Schmidt

[11] Patent Number: 4,460,050

[45] Date of Patent: Jul. 17, 1984

[54] PIPE DRIVING ATTACHMENT

[76] Inventor: Paul Schmidt, Winterberger Strasse, D-5940 Lennestadt 14, Fed. Rep. of Germany

[21] Appl. No.: 361,463

[22] Filed: Mar. 24, 1982

[30] Foreign Application Priority Data

Mar. 28, 1981 [DE] Fed. Rep. of Germany ..... 3112395

[51] Int. Cl.[3] ..... B25D 17/08

[52] U.S. Cl. ..... 173/128; 173/131; 173/132; 81/463; 29/275; 403/334; 403/368

[58] Field of Search ..... 173/90, 131, 132, 128; 81/463; 29/275, 254; 403/333, 334, 368, 369, 371

[56] References Cited

U.S. PATENT DOCUMENTS

| | | | |
|---|---|---|---|
| 1,178,143 | 4/1916 | Evans | 173/131 |
| 2,147,829 | 2/1939 | Daniels | 173/132 |
| 2,931,168 | 4/1960 | Frederick | 173/131 |
| 4,036,310 | 7/1977 | Schnell | 173/131 |
| 4,067,549 | 1/1978 | Konyak et al. | 173/131 |

*Primary Examiner*—E. R. Kazenske
*Assistant Examiner*—Taylor Ross
*Attorney, Agent, or Firm*—Toren, McGeady and Stanger

[57] ABSTRACT

An attachment for driving pipe wherein a plurality of concentric sleeves having diminishing diameters are arranged in driving engagement with a pipe end with a driving hammer operating to impart a driving force to the pipe, the sleeves being arranged to form a generally concial configuration such that the sleeves are in contact with each other at points which lie along lines of contact intersecting at the axis of the driving hammer to form an acute included angle.

4 Claims, 2 Drawing Figures

PIPE DRIVING ATTACHMENT

The present invention relates generally to a driving attachment for driving a pipe which is composed of a plurality of sleeves mounted at the end of a driving hammer and arranged to engage into each other, the sleeves being formed with a generally conical exterior.

During the driving of pipe, it is necessary to transfer the driving energy in a manner which is as protective as possible and which will enable complete transfer of the driving force from the driver implement into the pipe which is to be driven. This is usually accomplished with the aid of the driving end or point of a pipe driver which engages into the free end of the pipe or with driving attachments which are arranged between the driving implement and the pipe.

Such driving attachments engage either over the free end of the pipe to be driven or in a cupped manner in order to transfer driving strokes onto the end face of the pipe. Alternatively, the driving attachments may engage into the free end of the pipe.

Such driving attachments usually involve disadvantages in that they are suitable for only one single pipe diameter or for use over a very limited range of diameters so that for practical applications, greater numbers of driving attachment components having different dimensions are required.

In order to overcome this disadvantage, driving attachments are known which are comprised of several sleeves. The number of sleeves which fit into each other depends, in each case, upon the inner diameter of the pipe which is to be driven. The driving attachment may have a conical exterior and also engages into the free end of the pipe thereby expanding the pipe and thus creating a locking force-transmitting connection with the pipe. Consequently, pipes with widely varying diameters can be driven with an appropriate number of sleeves, each of the sleeves fitting one into the other.

The individual sleeves of such driving attachments have conical inner surfaces and outer surfaces and, when they are fitted one into the other, they tend to form an annular disc defining an inner cone which is adapted to have fitted therein the conical tip of a driver. The outer surface of the sleeve assembly forms an outer cone which is adapted to the inner diameter of the pipe which is to be driven.

However, a driving attachment of this type involves several disadvantages. For one, the axial driving force of such a pipe driver is introduced into the pipe with an excessively high horizontal component and a correspondingly small axial component. This results from the annular disc-shaped driving attachment. Such an arrangement gives rise to disadvantages for several reasons. For one reason, the large horizontal component produces a correspondingly strong expansion force on the free end of the pipe thereby giving rise to the possibility of undesirable damage. On the other hand, in such an annular disc-shaped driving attachment, only a small portion of the driving force is transferred to the pipe itself. Additional energy losses will finally result in the dampening of the driving energy by the annular disc-shaped driving attachment which, particularly in pipes having large diameters, acts to produce the effect of a diaphragm which considerably dampens the driving energy.

The present invention is directed toward overcoming disadvantages which arise with prior art devices and toward creating a driving attachment which transfers a high proportion of the driving force with a substantial axial force component into the pipe which is to be driven while at the same time protecting the pipe end as much as possible from damage while maintaining damping losses as small as possible.

SUMMARY OF THE INVENTION

Briefly, the present invention may be defined as an attachment for driving pipe comprising a plurality of sleeves having diminishing diameters arranged concentrically in driving engagement with each other and including a radially outermost and a radially innermost sleeve, said radially outermost sleeve being adapted to be engaged within the end of a pipe to be driven by said attachment, and a driving hammer in driving engagement with said radially innermost sleeve to impart a driving force to said pipe through said plurality of sleeves in the axial direction of said pipe, said plurality of sleeves being arranged to form a generally conical configuration extending axially of said pipe.

By another aspect of the invention, the plurality of sleeves are arranged to be in contact with each other at points of contact which lie along lines of contact which intersect each other at the axis of the driving hammer to form an acute included angle.

The solution provided by the present invention is based upon the concept of abandoning the annular disc-like configuration of conventional driving attachments in favor of a configuration wherein the plurality of driving sleeves are formed in the outline of a truncated cone formed by the interfitting sleeves. Thus, in accordance with the present invention, the assembly plurality of sleeves fitted one into the other will form an overall conical configuration.

Furthermore, the included angle between the lines of contact of the sleeves is an acute angle thereby reducing the horizontal component of the transmitted force. The smaller the included angle of the cone formed by the assembly of sleeves, the smaller will be the horizontal component of the driving force and the greater will be the axial component which is transferred into the pipe to be driven.

Additionally, there is a significantly reduced damping effect compared with the annular disc-shaped driving attachments. This not only operates to conserve energy, but also protects to a great extent the free end of the pipe.

Thus, after the driving action of the attachment has been completed, the mounted sleeves may easily be detached from the driving end or point of the driver by separation thereof one from another. The inner walls of the annular sleeves of the invention are formed to extend partially with a conical configuration and partially with a cylindrical configuration. The respective contact surfaces are limited to the conically extending portions of the inner walls of the sleeves and thus they may be kept relatively small.

In the assembled condition, the mounted sleeves may form a stepped cone which is open in directions toward the pipe with the number of steps of the stepped cone corresponding to the number of sleeves interfitted one into the other. Particularly favorable conditions result when two straight lines which are placed in the cross-section through the contact surfaces of the individual sleeves intersect at an acute angle at a point on the centerline of the driving hammer.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
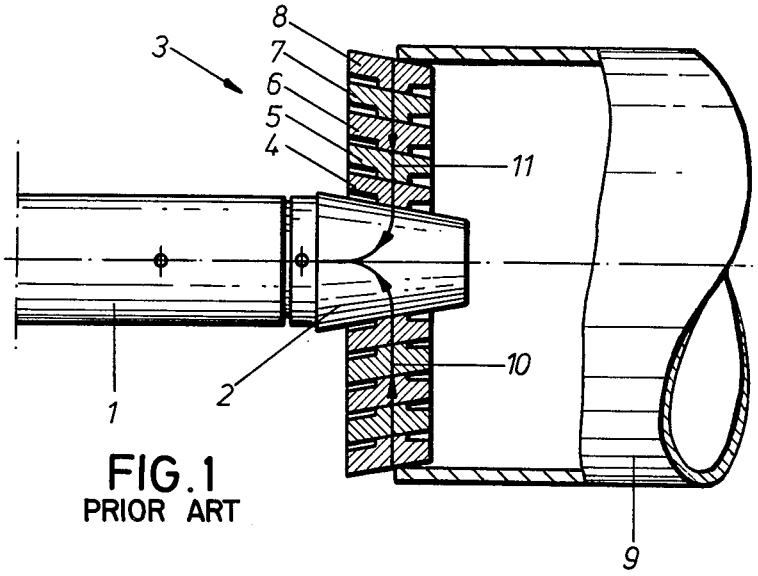
FIG. 1 PRIOR ART
FIG. 1 is a sectional view showing a conventional pipe driving attachment.

The present invention will be better understood by considering first the description of a conventional pipe driving attachment such as that shown in FIG. 1. In the device shown in FIG. 1 there is provided a pipe driver 1 which fits with a conical inner tip 2 into an annular disc 3 which is formed as an assembly of annular sleeves 4, 5, 6, 7, and 8. The several sleeves 4–8 are formed with a conical configuration on the inside and outside thereof and the radially outermost sleeve 8 engages with its conical outer wall into the free end of a pipe 9 which is to be driven.

In such a driving attachment, the driving force which originates from the pipe driver 1 is deflected in directions along the arrows 10 and 11 almost perpendicularly to the driving direction of the imparting driving force. Because the force lines 10 and 11 extending between the pipe driver 1 and the pipe 9 are directed transversely, and almost perpendicularly, to the driving direction, there tends to occur a substantial expansion of the free end of the pipe with a very firm fit of the driving attachment in the pipe. Furthermore, fairly high energy losses also occur.

Figure 2:
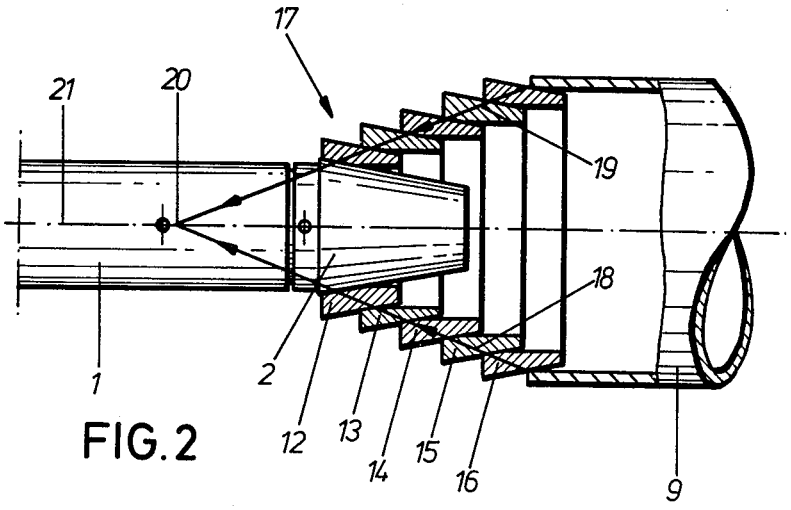
FIG. 2 is a sectional view showing a pipe driving attachment in accordance with the present invention.

A pipe driving attachment in accordance with the present invention is shown in FIG. 2. In FIG. 2, the pipe driver 1 with its conical driving tip 2 is arranged to extend into a conically shaped assembly comprised of a plurality of individual sleeves 12, 13, 14, 15, and 16. The plurality of sleeves 12–16 tend to form a relatively acute-angled stepped cone 17 which opens in a direction toward the pipe 9 with the result that the lines of transmitted force indicated by the arrows 18 and 19 intersect each other with an acute included angle at a point 20 which lies upon a centerline 21 of the driver 1. The lines 18 and 19 are arranged to connect together points of contact between the sleeves 12–16 and, as a result of the configuration of the cone assembly formed by the plurality of sleeves 12–16, there is a significant reduction in the horizontal component of the force which is applied to drive the pipe 9. The smaller horizontal component force thereby results in significantly reduced energy losses and also in considerably less expansion of the pipe end during the driving operation. Furthermore, substantially less damping of the driving strokes occurs as compared with a conventional driving attachment such as that shown in FIG. 1.

Since the diameter of the individual sleeves 12–16 is stepped in such a manner that they each correspond to a diameter difference of the pipe to be driven of approximately 100 mm, they may be kept relatively short so that the weight of the sleeves is relatively low. A further advantage lies in that with the aid of an appropriate selection of sleeves, practially all existing diameter differences between the driver tip 2 on the one hand and the pipe wall on the other hand may be bridged. The driving attachment in accordance with the invention is therefore also suitable for use with drivers having different driver tip diameters.

Additionally, it will be noted that the inner walls of the sleeves 12–16 are formed partially with a conical configuration and partially with a cylindrical configuration thereby facilitating detachment of the sleeves one from the other after use.

While a specific embodiment of the invention has been shown and described in detail to illustrate the application of the inventive principles, it will be understood that the invention may be embodied otherwise without departing from such principles.

What is claimed is:

1. An attachment for driving pipe comprising: a plurality of sleeves arranged to form a generally conical configuration, said plurality of sleeves having diminishing diameters arranged concentrically in driving engagement with each other and including a radially outermost and a radially innermost sleeve, said radially outermost sleeve being adapted to be engaged with the end of a pipe to be driven by said attachment; and a driving hammer in driving engagement with said radially innermost sleeve to impart a driving force to said pipe through said plurality of sleeves in the axial direction of said pipe; and plurality of sleeves being arranged to form a stepped cone.

2. An attachment according to claim 1 wherein the inner walls of each of said plurality of sleeves is formed partially with a conical configuration and partially with a cylindrical configuration.

3. An attachment according to claim 1 or 2 wherein said plurality of sleeves are in contact with each other at points of contact which lie along lines which intersect at the axis of said driving hammer to form an acute included angle.

4. An attachment for driving pipe comprising: a plurality of sleeves having diminishing diameters arranged concentrically in driving engagement with each other and including a radially outermost and a radially innermost sleeve, said radially outermost sleeve being adapted to be engaged with the end of a pipe to be driven by said attachment; and a driving hammer in driving engagement with said radially innermost sleeve to impart a driving force to said pipe through said plurality of sleeves in the axial direction of said pipe; said plurality of sleeves being arranged to form a generally coincal configuration; said plurality of sleeves being in contact with each other at points of contact which lie along diametrically opposed lines which from an acute included angle and intersect at the axis of said driving hammer.

* * * * *